US008647407B2

(12) United States Patent
Lin et al.

(10) Patent No.: US 8,647,407 B2
(45) Date of Patent: Feb. 11, 2014

(54) METHOD OF FABRICATING INDIUM-111 RADIOACTIVE ISOTOPE

(75) Inventors: Wuu-Jyh Lin, Taoyuan County (TW); Chien-Hsin Lu, Taoyuan County (TW); Jenn-Tzong Chen, Taipei (TW); Sun-Rong Hwang, Taoyuan County (TW); Ying-Chieh Wang, Pingtung County (TW)

(73) Assignee: Institute of Nuclear Energy Research, Atomic Energy Council, Lungtan, Taoyuan (TW)

( * ) Notice: Subject to any disclaimer, the term of this patent is extended or adjusted under 35 U.S.C. 154(b) by 0 days.

(21) Appl. No.: 13/352,550

(22) Filed: Jan. 18, 2012

(65) Prior Publication Data

US 2013/0104697 A1 May 2, 2013

(30) Foreign Application Priority Data

Oct. 27, 2011 (TW) ..... 100139192 A

(51) Int. Cl.
*C22B 58/00* (2006.01)

(52) U.S. Cl.
USPC ..... 75/393; 210/638

(58) Field of Classification Search
USPC ..... 75/393
See application file for complete search history.

(56) References Cited

U.S. PATENT DOCUMENTS

| | | | | |
|---|---|---|---|---|
| 3,180,812 | A * | 4/1965 | Beau | 205/564 |
| 4,556,538 | A * | 12/1985 | Matsushita et al. | 422/70 |
| 6,162,648 | A * | 12/2000 | Maloney et al. | 436/178 |
| 6,846,470 | B2 * | 1/2005 | Hattori et al. | 423/24 |
| 7,611,631 | B2 * | 11/2009 | Ohnishi et al. | 210/684 |
| 2003/0017419 | A1 * | 1/2003 | Futase et al. | 430/311 |

OTHER PUBLICATIONS

Wanekaya et al. Pressure-assisted chelating extraction: a clean approach for removal of metal ions from industrial and environmental wastes, Symposia of Environmental Chemistry American Chemical Society, Aug. 18-22, 2002, vol. 42, p. 584-591.*

Fakhari, Separation and purification of 111In from irradiated cadmium targets by solid phase extraction method for medical application, 2006, Dissertation, Der Philipps-Universitat Marburg.*

* cited by examiner

*Primary Examiner* — Roy King
*Assistant Examiner* — Xiaowei Su
(74) *Attorney, Agent, or Firm* — Jackson IPG PLLC

(57) ABSTRACT

The present invention provides a method for fabricating an indium(In)-111 radioactive isotope. A target of cadmium (Cd)-112 is processed through steps of dissolving with heat, absorbing, washing, desorbing and drying for obtaining the In-111 radioactive isotope. Thus, chemical separation is coordinated with the target for fabricating the In-111 radioactive isotope with high efficiency and low cost for production procedure.

6 Claims, 6 Drawing Sheets

METHOD OF FABRICATING INDIUM-111 RADIOACTIVE ISOTOPE

TECHNICAL FIELD OF THE INVENTION

The present invention relates to fabricating an indium(In)-111 radioactive isotope; more particularly, relates to using chemical separation to be coordinated with a target for fabricating the In-111 radioactive isotope with high efficiency and low cost for production procedure.

DESCRIPTION OF THE RELATED ARTS

Isotope is an element having the same number of protons but a different number of neutrons. Owing to the different number of neutrons, the isotope obtains different characteristics, where any isotope being radioactive is called a radioactive isotope and, on the contrary, non-radioactive one is a stable isotope.

Within a nucleus, there are only two kinds of particles, which are protons and neutrons. Electrons are always running around the nucleus. Radioactive isotopes can be found in nature. Additionally, artificial radioactive isotopes are mainly made in two ways: one is to send neutron into the nucleus; and the other is to send proton into the nucleus.

For making an isotope by sending neutron into the nucleus, neutron obtained through a nuclear reactor is used. After the neutron enters into the nucleus, gamma(γ)-ray is released as the neutron and weight are added onto the nucleus to make some particles become radioactive. Thus, artificial radioactive isotopes are formed, like molybdenum(Mo)-99, iodine (I)-131, cobalt(Co)-60, rhenium(Re)-188, etc. For making an isotope by sending proton into the nucleus, a proton accelerator is used. The accelerator increases energy of proton to make proton enter into the nucleus and collide out proton or neutron for obtaining artificial radioactive isotopes, like fluorine(F)-18, 1-123, thallium(TI)-201, indium(In)-111, etc.

Yet, for making an In-111 radioactive isotope, the above prior arts have low efficiencies and high costs for production procedure. Hence, the prior arts do not fulfill all users' requests on actual use.

SUMMARY OF THE INVENTION

The main purpose of the present invention is to use chemical separation to be coordinated with a target for fabricating an In-111 radioactive isotope with high efficiency and low cost for production procedure.

To achieve the above purpose, the present invention is a method of fabricating an In-111 radioactive isotope, comprising steps of: (a) obtaining a heating plate in a bromic acid solution with a target having a surface of cadmium(Cd)-112 obtained on the heating plate and adding pressure on the target to be dissolved with heat coordinated with the heating plate to obtain a solution of In-111 and Cd-112; (b) extracting the solution of In-111 and Cd-112 to be put into a tube to process ion exchange to adsorb In-111 in the tube and drain a solution of Cd-112; (c) adding a bromic acid solution into the tube to wash out In-111 with a waste liquid drained; (d) adding a bromic acid solution into the tube to desorb In-111 with the bromic acid solution drained together to obtain an In-111 semi-product liquid; and (e) drying the In-111 semi-product liquid to obtain a product of In-111 radioactive isotope. Accordingly, a novel method of fabricating an In-111 radioactive isotope is obtained.

BRIEF DESCRIPTIONS OF THE DRAWINGS

The present invention will be better understood from the following detailed description of the preferred embodiment according to the present invention, taken in conjunction with the accompanying drawings, in which FIG. 1 is the flow view showing the preferred embodiment according to the present invention;

DESCRIPTION OF THE PREFERRED EMBODIMENT(S)

The following description of the preferred embodiment is provided to understand the features and the structures of the present invention.

Figure 1:
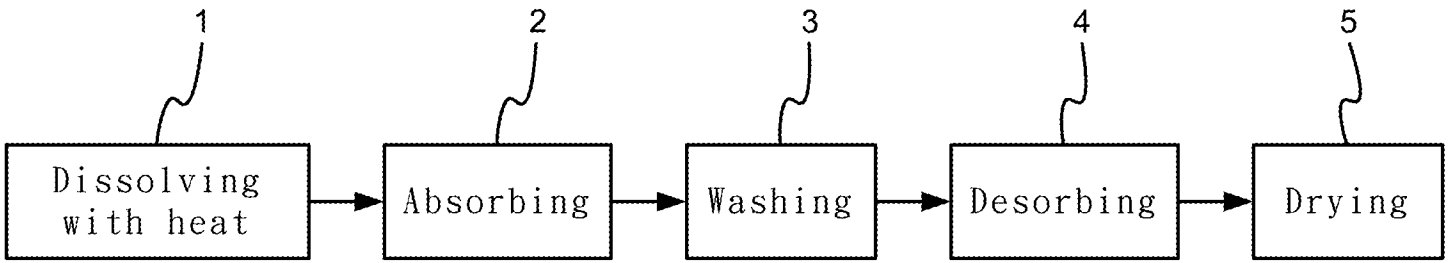
Figure 2:
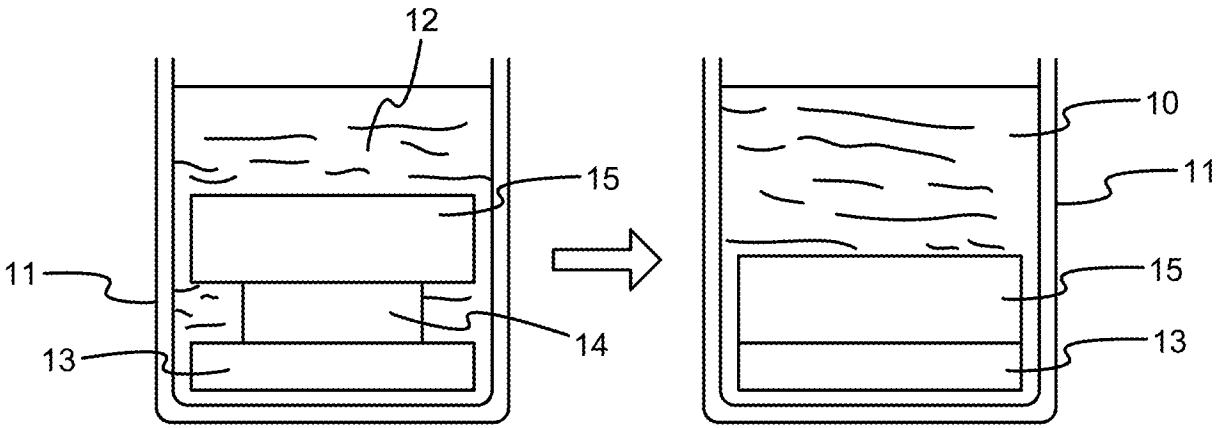
FIG. 2 is the view showing step (a)
Figure 3:
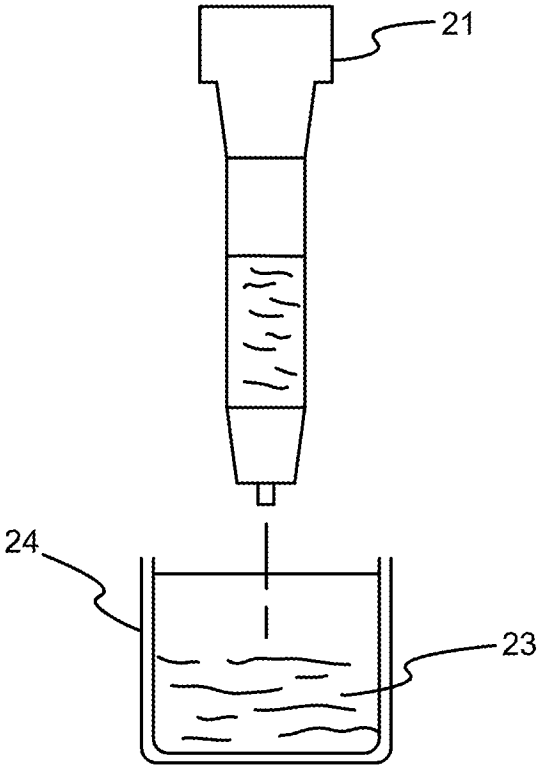
FIG. 3 is the view showing step (b)
Figure 4:
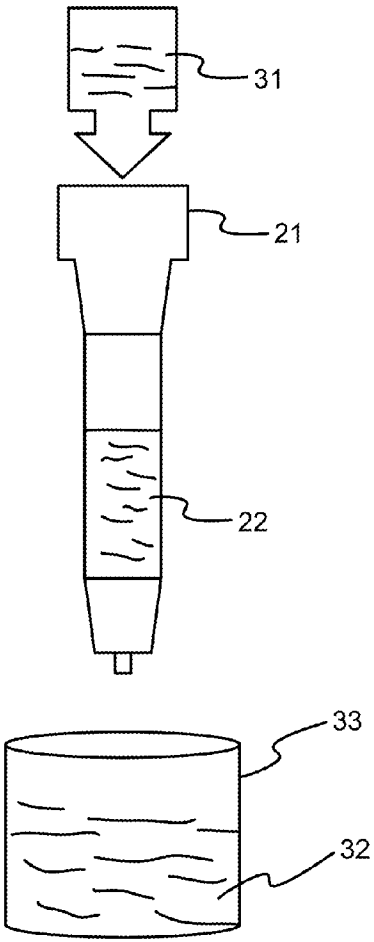
FIG. 4 is the view showing step (c)
Figure 5:
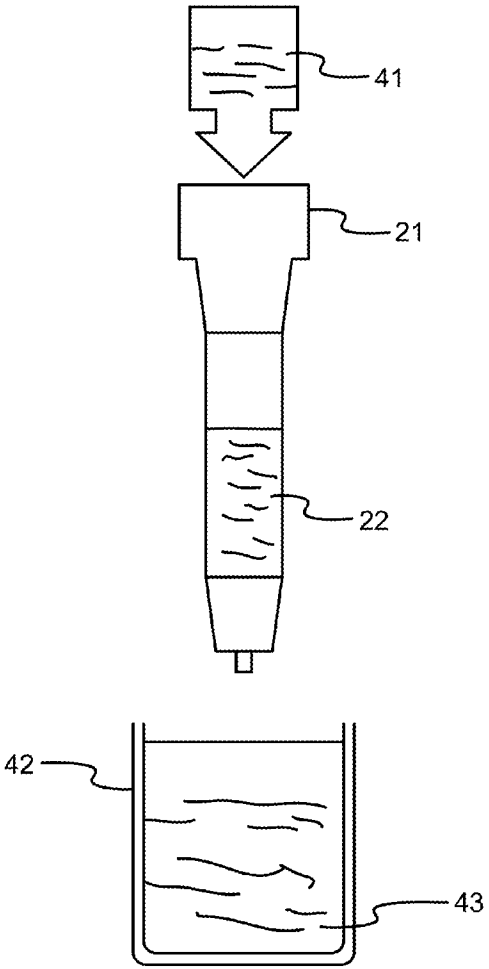
FIG. 5 is the view showing step (d)
Figure 6:
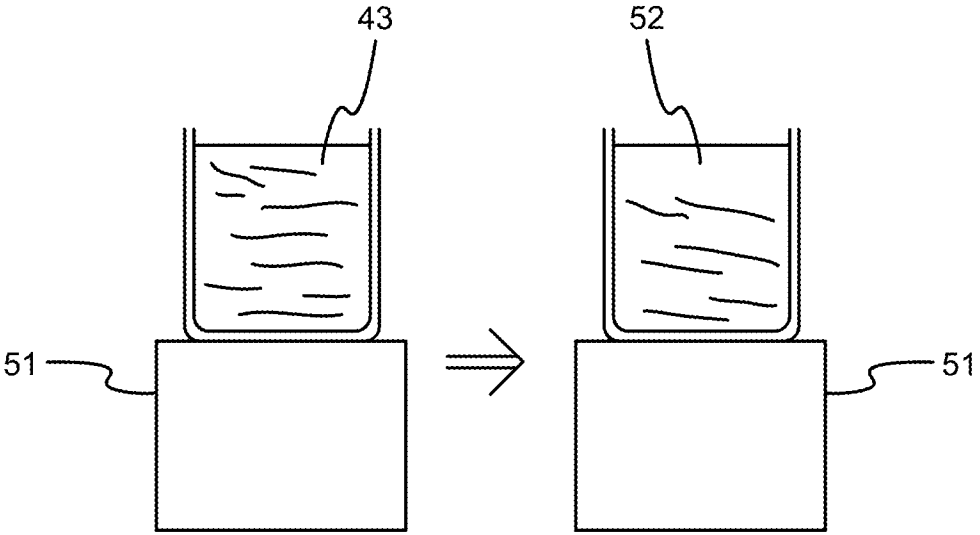
FIG. 6 is the view showing step (e).

Please refer to FIG. 1 to FIG. 6, which are a flow view showing a preferred embodiment according to the present invention and views showing step (a) to step (e). As shown in the figures, the present invention is a method of fabricating an indium(In)-111 radioactive isotope, where chemical separation is used for fabrication, including steps of dissolving with heat 1, absorbing 2, washing 3, desorbing 4 and drying 5 as follows:

(a) Dissolving with heat 1: A bromic acid solution 12 having a mole concentration of 8N is filled into a container 11; a heating plate 13 is set in the 8N bromic acid solution 12; a target having a surface of cadmium(Cd)-112 is set on the heating plate; a pressing unit 15 is used to add pressure on the target 14; the heating plate 12 is coordinated to heat up temperature for dissolving; and, thus, a solution of In-111 and Cd-112 10 is formed.

(b) Absorbing 2: The solution of In-111 and Cd-112 10 is extracted to be put into a tube 21 to process ion exchange, where the tube 21 is a resin column. Thus, In-111 is adsorbed in the tube 21 and a solution of Cd-112 is drained to and held in a recycling tank after processing ion exchange.

(c) Washing 3: A bromic acid solution 31 having a mole concentration of 8N is added into the tube 21 to wash out In-111 22 and, then, a waste liquid 32 is drained to be held in a waste tank 33.

(d) Desorbing 4: A bromic acid solution 41 having a mole concentration of 2N is added into the tube 21 to desorb In-111 22 and the bromic acid solution 41 is drained together for forming an In-111 semi-product liquid 43 to be held in a storing tank 42.

(e) Drying 5: The In-111 semi-product liquid 43 is dried by using a heating unit 51 to form a product of In-111 radioactive isotope 52; and, then, the product of In-111 radioactive isotope 52 is coordinated with a hydrochloric acid solution having a mole concentration of 0.01N to be filled through a filter having mini-pores into a product container (not shown in the figures). Additionally, after forming the product of In-111 radioactive isotope 52 by drying, the product of In-111 radioactive isotope 52 can be set in another tube to obtain the product of In-111 radioactive isotope 52 having a high purity by repeating at least one time of step (b) to step (e) of absorbing 2, washing 3, desorbing 4 and drying 5.

Thus, a novel method of fabricating an indium(In)-111 radioactive isotope is obtained.

Since the present invention uses a Cd-112 target for fabricating the In-111 radioactive isotope, the Cd-112 target has to be made in advance, which may include the following steps:

[Preparation]

1. A 2.5±0.1 g powder of Cd-112 oxide is obtained through a pair of electric balances to be put into a 500 ml beaker.

2. 8±0.1 g of sodium cyanide is obtained with a 50 ml beaker through the pair of electric balances to be poured into the powder of Cd-112 oxide.

3. 1.2±0.05 g of sodium hydroxide is obtained with the 50 ml beaker through the pair of electric balances to be poured into the powder of Cd-112 oxide.

4. 50±5 ml of distilled water is added to be stirred by a stirrer in a low speed for avoiding splashing.

5. After the Cd-112 oxide powder is totally dissolved and the solution becomes clear totally, the solution is diluted to 100±2 ml to be poured into an electric plating cell.

6. The beaker is washed with 70±2 ml of distilled water for three time and the water washed out is poured into the electric plating cell. Thus, an electroplating solution is obtained.

[Plating]

1. A hexagonal head wrench is used with depart a target back alumina stand from a plated target. A surface of the plated target is polished with a thin sandpaper to be rinsed with pure water for forming a water film phenomenon. Then, the plated target is wiped dry.

2. An electric power supply and a voltage recorder are prepared.

3. The electric plating cell is assembled with the plated target.

4. Nitrogen gas is flown in coordinated with steady stirring in the electric plating cell.

5. The electroplating solution is poured into the electric plating cell to be heated by a glass heater with the nitrogen flown in.

6. The plated target is connected with a cathode of the electric power supply and a platinum plate is connected with an anode of the electric power supply.

7. The voltage recorder and the electric power supply are run for electric plating at a current of 150±5 mA. (When the voltage goes down to 3.5V during plating, stop heating; and, after the voltage rises up to 3.8V, resume heating.)

8. Time for plating is decided by the needed weight for the plated target. After the needed weight for the plated target is obtained, the nitrogen gas, the electric power supply and the voltage recorder are shut down and the connections to the electric power supply are broken.

9. A vacuum transfer system is used to extract the plating solution; the electric plating cell and surfaces of the plated target are washed; and, then, the plated target is obtained for examination.

10. The plated target is examined for quality. If the plated target does not reach the needed weight, it is put into the plating solution again for plating. If the plated target is overweighted, it is also put into the plating solution for reversing the plating.

11. The target back alumina stand is locked back to the plated target.

12. The waste solution obtained after plating is drained in a bottle for use next time.

Thus, a target of Cd-112 is made for the chemical separation of the present invention.

To sum up, the present invention is a method of fabricating an In-111 radioactive isotope, where chemical separation is coordinated with a target for fabricating an In-111 radioactive isotope with high efficiency and low cost for production procedure.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A method of fabricating an indium(In)-111 radioactive isotope, comprising the steps of:

(a) admixing a first bromic acid solution having a molar concentration of 8N with a target having a surface of cadmium(Cd)-112 in a container, wherein said target having a surface of Cd-112 is proton irradiated to produce a proton irradiated target; placing said proton irradiated target onto a heating plate which elevates temperature and compresses the proton irradiated target between the heating plate and a pressing unit, all arranged in the container, so as to be dissolved to obtain a solution of In-111 and Cd-112;

(b) applying said solution of In-111 and Cd-112 to an ion exchange resin, wherein said In-111 is absorbed onto said resin and said Cd-112 flows through and is held in a recycling tank;

(c) applying a second 8N bromic acid solution to said ion exchange resin to wash out In-111 and then drain a waste liquid into a waste tank;

(d) applying a third 2N bromic acid solution to said ion exchange resin to desorb In-111 and collecting the flowthrough to obtain an In-111 semi-product liquid;

(e) drying said In-111 semi-product liquid to obtain a product of In-111 radioactive isotope; and (f) coordinating the product of In-111 radioactive isotope with a 0.01N hydrochloric acid solution to be filtered.

2. The method according to claim 1, wherein said resin is an ion exchange column.

3. The method according to claim 1, wherein, in step (d), said In-111 semi-product liquid is held in a storing tank.

4. The method according to claim 1, wherein, in step (e), said In-111 semi-product liquid is dried by using a heating unit.

5. The method according to claim 1, wherein said product of In-111 radioactive isotope is coordinated with the hydrochloric acid solution having a mole concentration of 0.01N to be filled through a filter having mini-pores into a product container.

6. The method according to claim 1, wherein, after obtaining said product of In-111 radioactive isotope, step (b) through step (e) are repeated.

* * * * *